US005792515A

United States Patent [19]

Blake et al.

[11] Patent Number: 5,792,515

[45] Date of Patent: Aug. 11, 1998

[54] COATING PROCESSES

[75] Inventors: Terence Desmond Blake, Tring; Stephen David Morley, Welwyn, both of England

[73] Assignee: Eastman Kodak Company, Rochester, N.Y.

[21] Appl. No.: 706,949

[22] Filed: Sep. 3, 1996

[30] Foreign Application Priority Data

Sep. 29, 1995 [GB] United Kingdom ..... 9519859

[51] Int. Cl.[6] ..... B05D 3/02

[52] U.S. Cl. ..... 427/384; 427/299; 427/322; 427/444

[58] Field of Search ..... 427/384, 299, 427/322, 444

[56] References Cited

U.S. PATENT DOCUMENTS

| | | | |
|---|---|---|---|
| 3,516,844 | 6/1970 | Padday | 117/34 |
| 5,418,128 | 5/1995 | Orem | 430/631 |
| 5,480,760 | 1/1996 | Bailey et al. | 430/203 |

FOREIGN PATENT DOCUMENTS

| | | |
|---|---|---|
| 0111338A2 | 12/1983 | European Pat. Off. . |
| 0461772A2 | 5/1991 | European Pat. Off. . |
| 0569925A2 | 5/1993 | European Pat. Off. . |
| 1186866 | 6/1967 | United Kingdom . |

OTHER PUBLICATIONS

Kistler, SF, 1973 in "Wettability", ed. JC Berg, Marcel Dekker, NY (no month avail.).

Gutoff EB & Kendrick CE, 1982, AIChE, J., 28, 459 "Dynamic Contact Angles"0 (no date avail.).

Buonopane RA, Gutoff EB & Einmore MMTR, 1986 AIChE. J., 32, 682, "Effect of Plunging Tape Surface Properties on Air Entrainment Velocity" (no month avail.).

Perry RT, 1967, PhD Thesis, University of Minnesota, Minneapolis (no month avail.).

Owens DK & Wendt RC, 1969, J. App. Polymer Sci., 13, 1741, "Estimation of the Surface Free Energy of Polymers" (no month avail.).

Fowkes (1962, J. Phys. Chem., 66, 382), Determination of Interfacial Tensions Contact Angles and Dispersion Forces in Surfaces by Assuming Additivity of Intermolecular Interactions in Surfaces (no month avail.).

*Primary Examiner*—Bernard Pianalto

*Attorney, Agent, or Firm*—Arthur H. Rosenstein

[57] ABSTRACT

It is well known that coating speeds are limited due to the onset of air entrainment. These limiting coating speeds have been found to be highest on solid surfaces of intermediate wettability with respect to water, and in particular, on surfaces having high dispersion and low polar surface free energies as determined by contact angle analysis. Described herein is a method of controlling the solid surface free energies, and hence maximum coating speeds, by using suitably chosen surfactants in subbing layers and pre-coated packs of the material being coated. Aromatic hydrocarbon ionic surfactants, such as Alkanol XC, aryl-ended sulphosuccinates and aryl-ended tricarballylates, are particularly beneficial in this respect.

9 Claims, 3 Drawing Sheets

STRUCTURE I $C_9H_{19}PhO-(CH_2CHO)_{10}-H$ $CH_2OH$ IOG

STRUCTURE II  ALKANOL XC

STRUCTURE III $C_8F_{17}SO_2NH(CH_2)_3N^+(CH_3)_3I^-$ FC135

STRUCTURE IV

STRUCTURE V

STRUCTURE VI

COATING PROCESSES

FIELD OF THE INVENTION

The present invention relates to improvements in or relating to coating processes and is more particularly concerned with increasing the coating speed of such processes.

BACKGROUND OF THE INVENTION

Coated photographic products normally comprise one or more layers of a hydrophilic colloidal composition. The vehicle for these coatings is usually gelatin and the layers are coated onto substrates, such as, paper, or acetate or polyester film. The films may carry a thin subbing layer to promote adhesion of the layers. The subbing layer is typically a hydrophilic colloidal composition comprising gelatin and other addenda including a cross-linking agent and a surfactant.

Sometimes the multilayers are coated in more than one stage such that during the second stage the upper layers are laid down on already coated lower layers. In either case, the coating compositions are coated onto layers containing the hydrophilic colloid (gelatin) together with various surfactants. These surfactants may be added as dispersing aids to promote coating uniformity and to impart desired physical properties to the dried-down coatings.

The processes by which solids are coated with liquids are usually considered to be governed by hydrodynamics. In particular, the main factors governing the limiting coating speed at the onset of air entrainment is usually assumed to be the viscosity and surface tension of the coating liquid. This is discussed by Kistler S. F., 1973 in *Wettability*, ed. J. C. Berg, Marcel Dekker, New York.

In contrast, the surface tension or surface free energy of the solid being coated is considered to affect the subsequent adhesion of the coating, but to have only a minor impact on coating speed as discussed by Gutoff E. B. & Kendrick C. E., 1982, *AIChE. J.*, 28, 459; Buonopane R. A., Gutoff E. B. & Rinmore MMTR, 1986, *AIChE. J.*, 32, 682 and the Kistler reference mentioned above.

If the influence of the solid surface is considered, it is normally concluded that a surface which is more 'wettable' will coat more readily, that is, it will yield a higher coating speed. This is discussed by Perry R. T., 1967, PhD Thesis, University of Minnesota, Minneapolis. In this context, a more 'wettable' surface is one which exhibits a smaller advancing contact angle with respect to the coating liquid.

GB-A-1 186 866 & U.S. Pat. No. 3,516,844 teach that the addition of certain non-ionic surfactants to a coating support leads to beneficial increases in coating speed. Such surfactants are expected to reduce the contact angle between the support and the aqueous coating solutions, thereby increasing coating speeds.

Since air entrainment commences when the dynamic contact angle between the liquid and the solid approaches 180°, it is commonly assumed by those skilled in the art that surfaces which exhibit low static advancing contact angles should also exhibit higher air entrainment speeds.

PROBLEM TO BE SOLVED BY THE INVENTION

The problem to be solved by the present invention is to maximize the coating speed of a liquid onto a substrate by controlling the wettability of the substrate.

SUMMARY OF THE INVENTION

It is therefore an object of the present invention to describe the relationship between the speed at which air entrainment occurs and the wettability of a substrate.

It is a further object of the present invention to demonstrate how wettability of a substrate is usefully characterized by the surface free energy of a substrate.

It is yet a further object of the present invention to demonstrate how the surface free energy, and hence wettability, of a substrate can be controlled to maximize coating speed.

In accordance with one aspect of the present invention, there is provided a method of increasing the maximum coating speed in a coating process wherein a liquid material is coated onto a substrate, characterized in that the dispersive surface free energy component of the substrate is greater than 30 $mNm^{-1}$.

Preferably, the dispersive surface free energy component of the substrate is greater than 35 $mNm^{-1}$.

It is preferred that the polar surface free energy component of the substrate is less than 10 $mNm^{-1}$.

It is also preferred that the calculated static advancing contact angle of water on the substrate falls within the range of 65° to 100°. This is calculated from the surface free energy components of the substrate and the surface tension components of water.

The substrate may include an aromatic hydrocarbon ionic surfactant, for example, Alkanol XC, sodium di-phenylpropyl sulphosuccinate, sodium di-phenylbutyl sulphosuccinate, or sodium tri-phenylethyl sulphotricarballylate.

Alternatively, the substrate may comprise a polymeric material.

ADVANTAGEOUS EFFECT OF THE INVENTION

By controlling the wettability of the substrate, it is possible to increase the coating speed at which air entrainment occurs.

Unexpectedly, the maximum coating speeds are found not to occur with maximum wettability of the substrate as determined by static advancing contact angles, but can be maximized by controlling the surface free energy of the substrate.

In particular, the coating speed can be increased by selecting a substrate which has provides surface free energy components in the ranges mentioned above. Naturally, this may be achieved by choosing a suitable substrate in accordance with methods known to those skilled in the art.

BRIEF DESCRIPTION OF THE DRAWINGS

For a better understanding of the present invention, reference will now be made, by way of example only, to the accompanying drawings in which.

DETAILED DESCRIPTION OF THE INVENTION

As used herein, the term "liquid material" refers to any material which is to be coated onto a substrate using conventional coating processes.

The term "substrate" is used to refer to any material onto which a liquid material is coated.

The dispersive and polar surface free energy components of the solid surface in each case were determined using the method described by Owens D. K. & Wendt R. C., 1969, *J. App. Polymer Sci.*, 13, 1741 which utilizes two liquids.

Static advancing contact angles of various test liquids on either subbing layers or pre-coated layers were measured. It was found that different surfactants produce different levels of wettability. For example, non-ionic surfactants, such as 10G (ex Olin Corporation), Structure I in FIG. 1, produce surfaces which are highly wettable to water, that is, having small advancing contact angles. Ionic hydrocarbon surfactants, on the other hand, such as Alkanol XC (trade mark of E I Du Pont de Nemours & Co), Structure II in FIG. 1, produce surfaces which are less wettable, that is, having larger static advancing contact angles. Fluorocarbon surfaces produce very low energy surfaces which would be poorly wetted by water, that is, they would have very high static advancing contact angles, were it not for the fact that the surfactant is readily leached from the layer thereby lowering the surface tension of the water and lowering the static advancing contact angle. The fact that such surfaces have low surface free energy has been confirmed by contact angle measurements with hydrocarbon liquids (alkanes) which do not significantly leach fluorosurfactants.

In parallel with these wettability measurements, the maximum coating speed prior to the onset of air entrainment of an aqueous coating composition (15% aqueous gelatin) on each of the surfaces was determined.

Unexpectedly, it was found that ionic hydrocarbon surfactants produce the highest coating speeds—non-ionic surfactants, which impart the greatest wettability, giving lower coating speeds. Fluorocarbon surfactants were also found to give low coating speeds. It was found that the lowest coating speeds were obtained if the surfactant is both non-ionic and a fluorocarbon.

Figure 1:
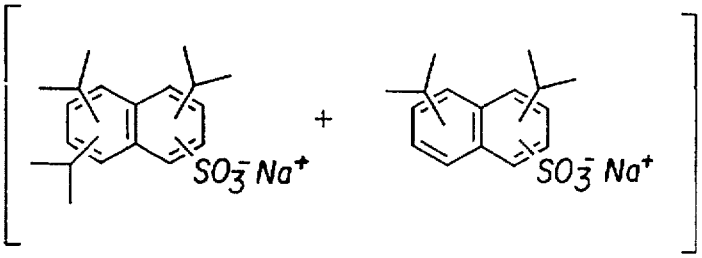
FIG. 1 illustrates the structures of six surfactants for which static advancing contact angles, dispersive surface free energy and polar surface free energy were compared.
Figure 1:
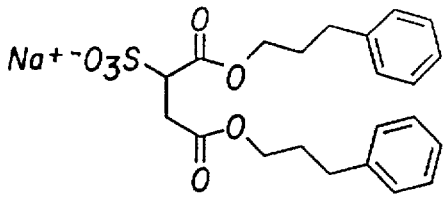
Figure 1:
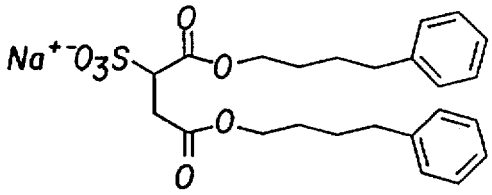
Figure 1:
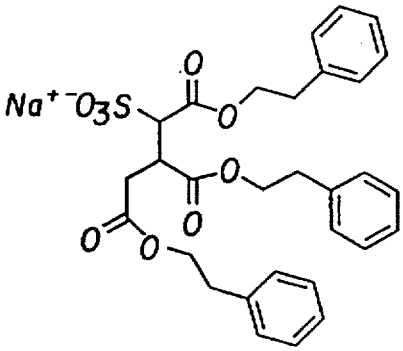
Figure 2:
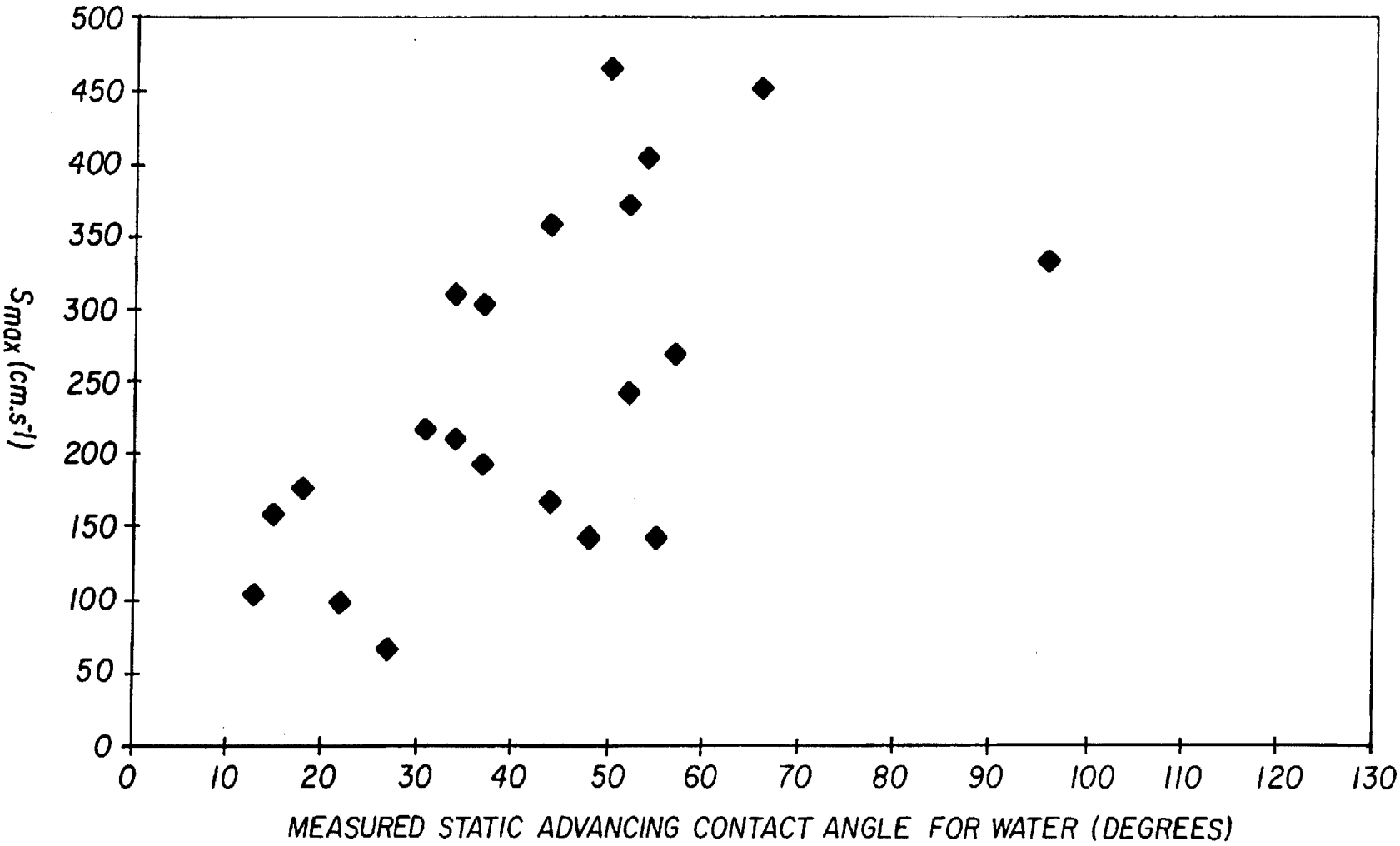
FIG. 2 shows a graph illustrating maximum coating speed as a function of measured static advancing contact angle for water.

More particularly, it was found that surfactants which give static advancing contact angles for water of less than 30° give the lowest coating speeds. The highest coating speeds are obtained with surfactants which give static advancing contact angles for water of greater than 30°. This surprising result is illustrated in FIG. 2. Surfactants yielding the highest coating speeds tend to be anionic aromatic materials such as Alkanol XC, Structure II in FIG. 1.

Figure 3:
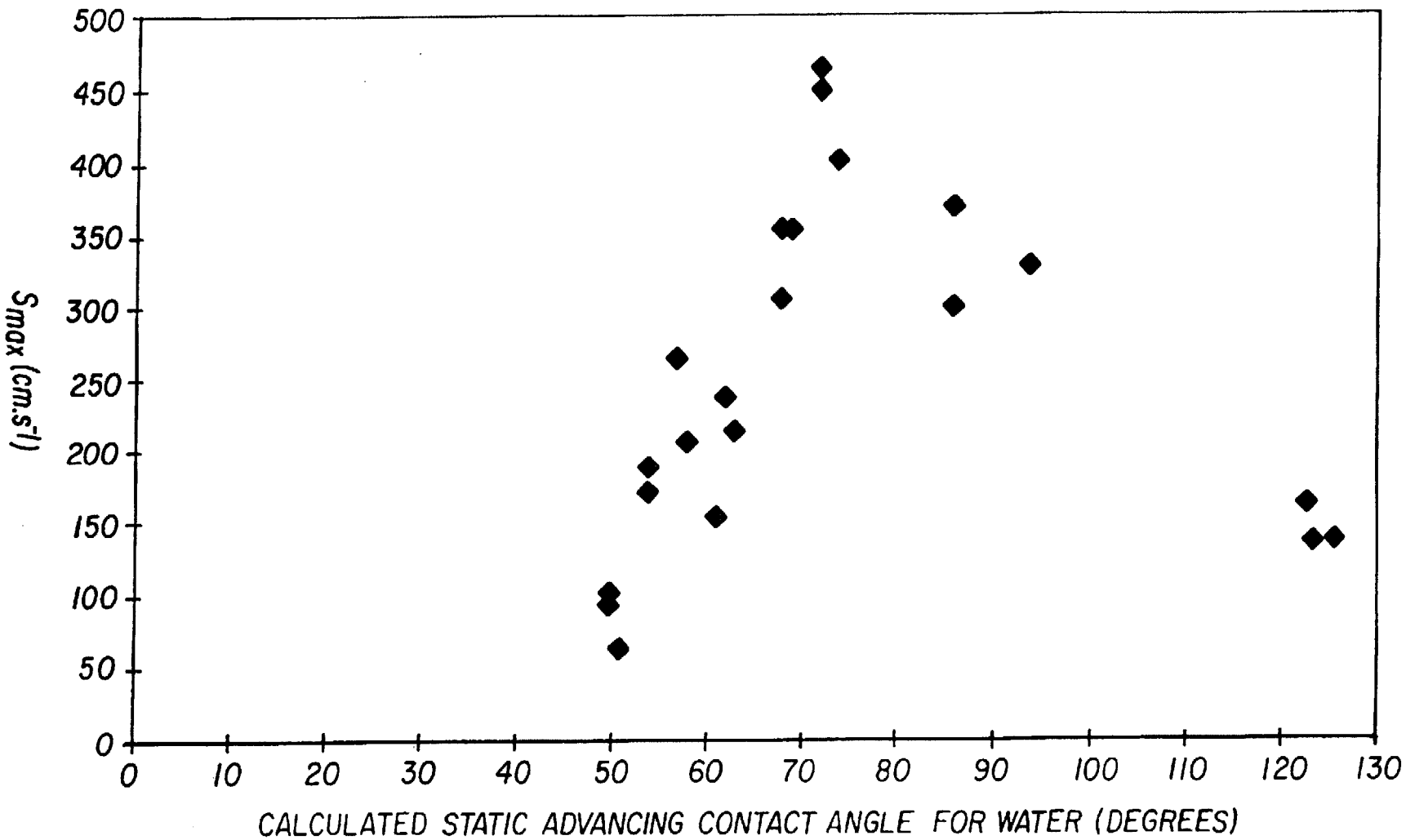
FIG. 3 shows a graph illustrating maximum coating speed as a function of calculated static advancing contact angle for water.

However, the measured static advancing contact angle with water is an insufficient criterion to determine coating speed due to the dissolution of certain surfactants, particularly fluorocarbon surfactants, into the water drop as described above. From a knowledge of the surface free energy components of the substrate, and the surface tension components of water, it is possible to calculate the static advancing contact angle which would be obtained with water in the absence of surfactant dissolution as will be discussed below. This is illustrated in FIG. 3. The relationship between wettability and coating speed is now much clearer. Surfactants which give calculated static advancing contact angles with water in the range of 65° to 100° give the highest coating speeds.

FIGS. 2 and 3 also show the results obtained with uncoated substrates, for example, polyethyleneteraphthalate film and polyethylene-coated paper. These materials show the same trend as for the coated substrates.

Contact angle studies using liquids having a wide range of surface tensions may be used to determine the surface free energy for each solid surface. If the liquids have differing polar and non-polar (dispersive) components of surface tension, the results may be analyzed to determine the free energy components of the solid surface using the method of Fowkes (1962, *J. Phys. Chem.*, 66, 382).

In accordance with the method described in the Owens et al. reference mentioned above, two liquids selected. These were 1-bromonaphthalene and 2,2'-thiodiethanol. The respective polar and dispersive components of their surface tensions are listed in Table 1.

TABLE 1

| Liquid | Surface Tension ($\gamma_L$, $mNm^{-1}$) | Dispersive Component ($\gamma_L^D$, $mNm^{-1}$) | Polar Component ($\gamma_L^P$, $mNm^{-1}$) |
|---|---|---|---|
| 1-bromonaphthalene | 44.6 | 43.7 | 0.9 |
| 2,2'-thiodiethanol | 54.0 | 33.6 | 20.4 |

In all, 19 solid surfaces containing one or more levels of some 16 different surfactants were investigated, together with 3 polymer surfaces.

A range of solid surfaces were prepared by bead-coating aqueous gelatin layers containing various surfactants onto pre-subbed polyethyleneteraphthalate film, as either single-layer or two layer coating packs. The coated composition of six representative coating packs, corresponding to the structures shown in FIG. 1, are listed in Table 2.

TABLE 2

| | Top Layer | | | Bottom Layer | | |
|---|---|---|---|---|---|---|
| Structure | Wet Laydown $gm^{-2}$ | Gelatin % w/w | Surfactant % w/w | Wet Laydown $gm^{-2}$ | Gelatin % w/w | Surfactant % w/w |
| I | 1.42 | 10.0 | 0.31 | 5.67 | 4.0 | 0.10 |
| II | 1.42 | 10.0 | 0.21 | 5.67 | 4.0 | 0.10 |
| III | 5.67 | 4.0 | 0.09 | N/A (single-layer coating) | | |
| IV | 5.30 | 7.0 | 0.50 | N/A (single-layer coating) | | |
| V | 5.30 | 7.0 | 0.15 | N/A (single-layer coating) | | |
| VI | 5.30 | 7.0 | 0.13 | N/A (single-layer coating) | | |

Static advancing contact angles were measured by the sessile drop method using a goniometer attached to a traveling microscope. Contact angles were measured two minutes after ceasing to advance the drop.

Dispersive and polar surface free energy values were determined by applying the two-liquid method as described in the Owens et al. reference mentioned above, and using the liquid surface tension parameters listed in Table 1 above.

The maximum coating speeds before the onset of air entrainment ($S_{max}$) were determined using a narrow-width curtain coating apparatus with a curtain height of 3 cm, an application angle of 0°, and with a coating solution of 15% w/w aqueous gelatin (low-shear viscosity between 65 and 75 mPas). $S_{max}$ occurred at a solution flow rate of 3.0 to 3.5 $cm^3s^{-1}cm^{-1}$ on each substrate.

In particular, six surfactants were compared as described in the Examples below:

EXAMPLE 1

A solid surface (substrate) was prepared containing a surfactant 10G (structure I in FIG. 1) as described in Table 2. The surface exhibited static advancing contact angles of 33° with 1-bromonaphthalene, 11° with 2,2'-thiodiethanol, and 13° with water.

Applying the method of Owens et al. yielded a dispersion surface free energy of 30 $mNm^{-1}$ and a polar surface free energy of 23 $mNm^{31\ 1}$.

The maximum coating speed before the onset of air entrainment was 103 $cms^{-1}$.

EXAMPLE 2

A solid surface (substrate) was prepared containing a surfactant Alkanol XC (structure II in FIG. 1) as described in Table 2. The surface exhibited static advancing contact angles of 39° with 1-bromonaphthalene, 58° with 2,2'-thiodiethanol, and 52° with water.

Applying the method of Owens et al. yielded a dispersion surface free energy of 33 $mNm^{-1}$ and a polar surface free energy of 3 $mNm^{-1}$.

The maximum coating speed before the onset of air entrainment was 370 $cms^{-1}$.

EXAMPLE 3

A solid surface (substrate) was prepared containing a surfactant FC135 manufactured by 3M (structure III in FIG. 1) as described in Table 2. The surface exhibited static advancing contact angles of 88° with 1-bromonaphthalene, 88° with 2,2'-thiodiethanol, and 48° with water.

Applying the method of Owens et al. yielded a dispersion surface free energy of 10 $mNm^{-1}$ and a polar surface free energy of 4 $mNm^{-1}$.

The maximum coating speed before the onset of air entrainment was 140 $cms^{-1}$.

EXAMPLE 4

A solid surface (substrate) was prepared containing sodium diphenylpropyl sulphosuccinate as a surfactant (structure IV in FIG. 1) as described in Table 2. The surface exhibited static advancing contact angles of 21° with 1-bromonaphthalene and 35° with 2,2'-thiodiethanol and 34° with water.

Applying the method of Owens et al. yielded a dispersion surface free energy of 37 $mNm^{-1}$ and a polar surface free energy of 9 $mNm^{-1}$.

The maximum coating speed before the onset of air entrainment was 308 $cms^{-1}$.

EXAMPLE 5

A solid surface (substrate) was prepared containing sodium diphenylbutyl sulphosuccinate as a surfactant (structure V in FIG. 1) as described in Table 2. The surface exhibited static advancing contact angles of 20° with 1-bromonaphthalene and 37° with 2,2'-thiodiethanol and 34° with water.

Applying the method of Owens et al. yielded a dispersion surface free energy of 38 $mNm^{-1}$ and a polar surface free energy of 8 $mNm^{-1}$.

The maximum coating speed before the onset of air entrainment was 355 $cms^{-1}$.

EXAMPLE 6

A solid surface was prepared containing sodium triphenylethyl sulphotricarballylate as a surfactant (structure VI in FIG. 1) as described in Table 2. The surface exhibited static advancing contact angles of 18° with 1-bromonaphthalene and 35° with 2,2'-thiodiethanol and 44° with water.

Applying the method of Owens et al. yielded a dispersion surface free energy of 38 $mNm^{-1}$ and a polar surface free energy of 9 $mNm^{-1}$.

The maximum coating speed before the onset of air entrainment was 355 $cms^{-1}$.

The results obtained for static advancing contact angles for each of the Examples are summarized in Table 3.

TABLE 3

| Structure | $\theta_{adv}$ 1-bromonaphthalene (°) | $\theta_{adv}$ 2,2'-thiodiethanol (°) | $\theta_{adv}$ water (°) |
|---|---|---|---|
| I | 33 | 11 | 13 |
| II | 39 | 58 | 52 |
| III | 88 | 88 | (48)* |
| IV | 21 | 35 | 34 |
| V | 20 | 37 | 34 |
| VI | 18 | 35 | 44 |

*Contact angle lower than expected due to fluorocarbon surfactant leaching into water drop. Angle predicted from surface energy is greater than 100°.

The surface free energy values and maximum coating speeds obtained are summarized in Table 4.

TABLE 4

| Structure | Dispersive Surface Free Energy Component ($mNm^{-1}$) | Polar Surface Free Energy Component ($mNm^{-1}$) | Maximum coating speed ($cms^{-1}$) |
|---|---|---|---|
| I | 30 | 23 | 103 |
| II | 33 | 3 | 370 |
| III | 10 | 4 | 140 |
| IV | 37 | 9 | 308 |
| V | 38 | 8 | 355 |
| VI | 38 | 9 | 355 |

Structure I is a non-ionic surfactant and structure III is a cationic surfactant, whereas structures II, IV, V and VI are anionic aromatic surfactants.

Analysis of the results obtained for all the experiments shows that surfactants which produce surfaces with high dispersion free energies tend to give high coating speeds, whereas surfactants producing surfaces having high polar surface free energy tend to give low coating speeds. Furthermore, it was found that surfaces which have both low dispersion surface free energy and high polar surface free energy give the lowest coating speeds. These results are summarized in Table 9 below.

As mentioned above, 22 different substrates were evaluated. The substrates/surfactant types fell into three groups as shown in Tables 5, 6 and 7. Table 5 relates to gelatin-coated substrates containing single surfactants, Table 6 relates to gelatin-coated substrates containing mixed surfactants, and Table 7 relates to other substrates.

TABLE 5

| No. | Surfactant Type and Concentration (% w/w top/bottom layer) | Supplier |
|---|---|---|
| 1 | Zonyl FSN (0.16) $C_8F_{17}CH_2CH_2(OCH_2CH_2)_{10}OH$ | E I DuPont de Nemours & Co |
| 2 | 10G (0.31/0.10) Structure I | Olin Corporation |
| 3 | Fluorad FC-135 (0.09) Structure II | 3M |
| 4 | Sodium di-(2,2,3,3,4,4,4-heptafluorobutyl) sulphosuccinate (0.30/0.12) | see U.S. Pat. No. 4,968,599 |
| 5 | Triton X-200E (0.20/0.06) - major component is t-$C_8H_{17}PhO(CH_2CH_2O)_2CH_2CH_2SO_3^-Na^+$, modified form of TX200 | Union Carbide, formally Rohm & Haas |
| 6 | FT248 (0.10/0.04)n-$C_8F_{17}SO_3^-(C_2H_5)_4N^+$ | Bayer |
| 7 | Texofor FN8 (0.05)t-$C_9H_{19}(OCH_2CH_2)_8OH$ | Rhone Poulenc, formally ABM Chemicals |
| 8 | Ethoquad C12 (0.038)[$C_{12-14}$]-$N^+(CH_2CH_2OH)_2CH_3Cl^-$ | Akzo Chemie |
| 9 | Ethoquad C25 (0.105)[$C_{12-14}$]-$N^+[(CH_2CH_2O)_XH][(CH_2CH_2O)_YH]CH_3Cl^-$mean (x + y) = 15 | Akzo Chemie |
| 10 | Arquad C50 (0.035)[$C_{12-14}$]-$N^+(CH_3)_3Cl^-$ | Akzo Chemie |
| 11 | Ethoquad O12 (0.047)[$C_{18}$unsaturated]-$N^+(CH_2CH_2OH)_2CH_3Cl^-$ | Alzo Chemie |
| 12 | Aerosol OT (0.10/0.05)Sodium di-(2-ethylhexyl)sulphosuccinate | Cyanamid |
| 13 | Sodium di-phenylpropyl sulphosuccinate (0.50) Structure IV | Eastman Kodak Company USP 5,484,695 (EP-A-0 674 221) |
| 14 | Sodium di-phenylbutyl sulphosuccinate (0.15) Structure V | Eastman Kodak Company USP 5,484,695 (EP-A-0 674 221) |
| 15 | Sodium tri-phenylethyl sulphotricarballylate (0.13) Structure VI | Eastman Kodak Company USP 5,484,695 (EP-A-0 674 221) |
| 16 | Alkanol XC (0.21/0.10) Structure II | E I DuPont de Nemours & Co |

TABLE 6

| No. | Surfactant Type and Concentration (% w/w) |
|---|---|
| 17 | Alkanol XC (0.04) + 10G (0.16) (Structures II & I) |
| 18 | Alkanol XC (0.10) + 10G (0.10) (Structures II & I) |
| 19 | Alkanol XC (0.16) + 10G (0.04) (Structures II & I) |

TABLE 7

| No. | Polymer Surface |
|---|---|
| 20 | Polyethylene-coated paper (glossy) |
| 21 | Polyethylene terephthalate (Estar*) |
| 22 | Gelatin-subbed Estar* |

*Estar is a registered trade mark of the Eastman Kodak Company

Three coating packs were used in combination with the substrates listed above. These coating packs are given in Table 8 below:

TABLE 8

| | TOP LAYER | | BOTTOM LAYER | |
|---|---|---|---|---|
| PACK | WET COMPO-SITION (% W/W GELATIN) | WET LAYDOWN ($gm^{-2}$) | WET COMPO-SITION (% W/W GELATIN) | WET LAYDOWN ($gm^{-2}$) |
| A | 7 | 5.3 | — | — |
| B | 10 | 1.42 | 4 | 5.67 |
| C | 4 | 5.67 | — | — |

In each of the coating packs, the surfactant/surfactant mixture was added to each layer of the pack at the w/w concentration specified in Tables 5 and 6. Each coating pack was then suitably dried and hardened.

TABLE 9

| | | STATIC ADVANCING CONTACT ANGLES (°) | | | SURFACE FREE ENERGY COMPONENTS ($mNm^{-1}$) | | | CALCULATED CONTACT ANGLE FOR WATER (°)# | MAXIMUM COATING SPEED |
|---|---|---|---|---|---|---|---|---|---|
| NO. | PACK | $\theta_{IBN}$ | $\theta_{TDE}$ | $\theta_{WATER}$ | $\gamma_S^D$ | $\gamma_S^P$ | $\gamma_S$ | $\theta_{WATER}$ | $S_{max}(cms^{-1})$ |
| 1 | A | 33 | 14 | 27 | 31 | 22 | 53 | 51 | 65 |
| 2 | B | 33 | 11 | 13 | 30 | 23 | 53 | 50 | 103 |
| 3 | C | 88 | 88 | 48 | 10 | 4 | 14 | 126* | 140 |
| 4 | B | 83 | 84 | 55 | 12 | 5 | 17 | 124* | 140 |
| 5 | B | 36 | 32 | 15 | 31 | 16 | 47 | 61 | 156 |
| 6 | B | 75 | (57)* | 44 | 13 | (22)* | 35 | 123* | 165 |
| 7 | A | 15 | 11 | 18 | 37 | 17 | 54 | 54 | 174 |
| 8 | A | 26 | 15 | 37 | 33 | 19 | 52 | 54 | 191 |
| 9 | A | 25 | 23 | 34 | 34 | 16 | 50 | 58 | 209 |
| 10 | A | 34 | 32 | 52 | 31 | 15 | 46 | 62 | 240 |
| 11 | A | 34 | 26 | 57 | 31 | 17 | 48 | 57 | 267 |
| 12 | B | 46 | 61 | 37 | 29 | 4 | 33 | 86 | 302 |
| 13 | A | 21 | 35 | 34 | 37 | 9 | 46 | 68 | 308 |
| 14 | A | 20 | 37 | 44 | 38 | 8 | 46 | 69 | 355 |
| 15 | A | 18 | 35 | 44 | 38 | 9 | 47 | 68 | 355 |
| 16 | B | 39 | 58 | 52 | 33 | 3 | 36 | 86 | 370 |
| 17 | A | 33 | 11 | 22 | 30 | 23 | 53 | 50 | 97 |
| 18 | A | 35 | 34 | 31 | 31 | 14 | 45 | 63 | 216 |

TABLE 9-continued

| | | STATIC ADVANCING CONTACT ANGLES (°) | | | SURFACE FREE ENERGY COMPONENTS ($mNm^{-1}$) | | | CALCULATED CONTACT ANGLE FOR WATER (°)* | MAXIMUM COATING SPEED |
|---|---|---|---|---|---|---|---|---|---|
| NO. | PACK | $\theta_{1BN}$ | $\theta_{TDE}$ | $\theta_{WATER}$ | $\gamma_S^D$ | $\gamma_S^P$ | $\gamma_S$ | $\theta_{WATER}$ | $S_{max}(cms^{-1})$ |
| 19 | A | 39 | 48 | 54 | 31 | 8 | 39 | 74 | 403 |
| 20 | — | 34 | 64 | 96 | 37 | 1 | 38 | 94 | 331 |
| 21 | — | 0 | 38 | 66 | 41 | 6 | 47 | 72 | 450 |
| 22 | — | 30 | 43 | 50 | 35 | 8 | 43 | 72 | 464 |

Notes for Table 9:

a) 1BN = 1-bromonaphthalene; TDE = 2,2'-thiodiethanol b) $\gamma_S^D$ = dispersive surface free energy; $\gamma_S^P$ = polar surface free energy; and $\gamma_S$ = total surface free energy

*For all substrates except those containing fluorocarbon surfactants, $$\cos\theta_{water}\text{ (calculated)} = -1 + \frac{2\sqrt{21.8\,\gamma_S^D} + 2\sqrt{51.0\,\gamma_S^P}}{72.8}$$

where the values 21.8, 51.0 and 72.8 refer to $\gamma_S^D$, $\gamma_S^P$ and $\gamma_S$ for water respectively in $mNm^{-1}$.

*Fluorocarbon surfactant leaching into 2,2'-thiodiethanol lowers the surface tension of the test liquid resulting in a lower contact angle than is expected, and hence an artificially high calculated polar surface free energy. Therefore, for substrates containing fluorocarbon surfactants, the polar surface free energy is assumed to be zero and $$\cos\theta_{water}\text{ (calculated)} = -1 + \frac{2\sqrt{21.8\,\gamma_S^D}}{72.8}$$

where the values 21.8 and 72.8 refer to $\gamma_S^D$ and $\gamma_S$ for water respectively in $mNm^{-1}$.

From Table 9, it can be seen that substrates giving low coating speeds either have polar surface free energy components which are greater than 10 $mNm^{-1}$, for example substrates 1, 2, 5, 7 to 11, 17 and 18, or dispersive surface free energy components less than 30 $mNm^{-1}$, for example substrates 3, 4 and 6.

The substrates giving the highest coating speeds, for example substrates 13 to 16, 19 to 22, all have polar surface free energy components which are less than 10 $mNm^{-1}$ and dispersive surface free energy components which are greater than 30 $mNm^{-1}$. The calculated static advancing constant angles for water on these substrates lie in the range of 65° to 100°.

Substrates 17 to 19, which contain mixtures of the surfactants of structures I and II in differing relative amounts, illustrate how the surface free energy components, and hence the coating speeds, can be carefully controlled by the use of surfactants.

Moreover, it can be seen that the increase of coating speed need not be achieved using surfactants. Polymers can also be used, for example substrates 20 to 22 given in Table 7.

We claim:

1. A method of increasing the maximum coating speed in a coating process comprising coating a liquid material onto a substrate, wherein the dispersive surface free energy component of the substrate is greater than 30 $mNm^{-1}$ and the polar surface free energy component of the substrate is less than 10 $mNm^{-1}$.

2. A method according to claim 1, wherein the dispersive surface free energy component of the substrate is greater than 35 $mNm^{-1}$.

3. A method according to claim 1, wherein the calculated static advancing contact angle for water on the substrate is in the range of 65° to 100°.

4. A method according to claim 3, wherein the substrate comprises a polymeric material.

5. A method according to claim 1, wherein the substrate includes an aromatic hydrocarbon ionic surfactant.

6. A method according to claim 5, wherein the surfactant comprises Alkanol XC.

7. A method according to claim 5, wherein the surfactant comprises sodium di-phenylpropyl sulphosuccinate.

8. A method according to claim 5, wherein the surfactant comprises sodium di-phenylbutyl sulphosuccinate.

9. A method according to claim 5, wherein the surfactant comprises sodium tri-phenylethyl sulphotricarballylate.

* * * * *